US010919818B1

(12) United States Patent
Rambow

(10) Patent No.: US 10,919,818 B1
(45) Date of Patent: Feb. 16, 2021

(54) AUTO-IGNITION COMPOSITION

(75) Inventor: Scott M. Rambow, Roseville, MI (US)

(73) Assignee: Joyson Safety Systems Acquisition LLC, Auburn Hills, MI (US)

( * ) Notice: Subject to any disclaimer, the term of this patent is extended or adjusted under 35 U.S.C. 154(b) by 318 days.

(21) Appl. No.: 13/199,253

(22) Filed: Aug. 23, 2011

Related U.S. Application Data

(60) Provisional application No. 61/375,978, filed on Aug. 23, 2010.

(51) Int. Cl.
*C06B 25/00* (2006.01)
*C06B 31/00* (2006.01)

(52) U.S. Cl.
CPC ..... *C06B 25/00* (2013.01); *C06B 31/00* (2013.01)

(58) Field of Classification Search
CPC ..... C06B 25/00; C06B 31/00
See application file for complete search history.

(56) References Cited

U.S. PATENT DOCUMENTS 5,431,103 A * 7/1995 Hock ..... C06B 23/009 102/289
6,132,537 A * 10/2000 Zeuner et al. ..... 149/45
2004/0084884 A1* 5/2004 Yamazaki et al. ..... 280/741
2005/0098247 A1* 5/2005 Wu ..... 149/45
2005/0189054 A1* 9/2005 Zeuner et al. ..... 149/109.6
2006/0137785 A1* 6/2006 Zeuner ..... C06B 23/02 149/19.2
2007/0034307 A1* 2/2007 Hordos ..... C06C 9/00 149/36

* cited by examiner

*Primary Examiner* — Aileen B Felton
(74) *Attorney, Agent, or Firm* — Meunier Carlin & Curfman LLC

(57) ABSTRACT

A gas generator 10 includes a composition that contains a nonmetal perchlorate such as ammonium perchlorate as a first oxidizer, a secondary metal nitrate oxidizer such as strontium nitrate or sodium nitrate, a first fuel such as maleic hydrazide and salts thereof, and a second nitrogen-containing fuel such as nitroguanidine or guanidine nitrate. Gas generating systems 180 such as vehicle occupant protection systems 180, containing the gas generator 10, are also provided.

18 Claims, 1 Drawing Sheet

AUTO-IGNITION COMPOSITION

CROSS-REFERENCE TO RELATED APPLICATIONS

This application claims the benefit of U.S. Provisional Application Ser. No. 61/375,978 filed on Aug. 23, 2010.

TECHNICAL FIELD

The present invention relates generally to gas generating systems, and to auto-ignition and booster compositions employed in gas generator devices for automotive restraint systems, for example.

BACKGROUND OF THE INVENTION

The present invention relates to gas generating compositions that upon ignition provide abundant amounts of gas, well above those typically found in similar gas generating compositions.

An ongoing challenge is to simplify the manufacture of a gas generator by reducing the constituents required in the production thereof. For example, in many gas generators used in vehicle occupant protection systems, several discrete compositions are provided to serve correspondingly discrete functions. These compositions often include a primary gas generating composition that when combusted is employed to provide sufficient quantities of gaseous products to operate the associated restraint device, such as an airbag or seatbelt pretensioner. A booster composition is utilized to elevate the pressure and heat within the gas generator prior to combustion of the primary gas generant, thereby creating favorable conditions within the inflator for acceptable combustion of the primary gas generant. Still yet another composition is the auto-ignition composition employed to provide safe combustion of the other compositions in the event of a fire. The auto-ignition composition is designed to ignite at temperatures below the melting point of the primary gas generant for example, thereby ensuring the controlled combustion of the primary gas generant, as opposed to an explosive reaction perhaps.

In general, it is desirable to have auto-ignition compositions that auto-ignite at temperatures of 200 C or less. More particularly, an auto-ignition range from 150 C to 180 C is even more favorable because of the performance advantages in the event of a bonfire event.

The use of potassium chlorate within an autoignition composition has been considered given the autoignition properties of this oxidizer. Furthermore, carboxylic acid in combination with potassium chlorate typically provides a desired autoignition temperature of 200 degrees Celsius or less. Nevertheless, these types of compositions typically do not provide anything but auto-ignition function when employed in gas generators used in vehicle occupant protection systems, for example. It is an ongoing challenge to create multifunctional compositions for use in what has been typically understood to be discrete and separate operations. For example, in many inflators, separate auto-ignition, booster, and primary gas generating compositions have been developed for their respective and separate functions. Including two or more of these functions in one composition would simplify manufacturing, reduce the manufacturing costs, and preferably provide performance efficiencies not heretofore realized.

SUMMARY OF THE INVENTION

The above-referenced concerns and others may be resolved by gas generating systems including an autoignition composition containing a first oxidizer selected from non-metal perchlorates such as ammonium perchlorate. Secondary oxidizers may also be employed including for example metal nitrates and nitrites, including strontium nitrate and sodium nitrate. A first fuel is selected from the group including maleic hydrazide, and metal and nonmetal salts of maleic hydrazide. A second fuel may be selected from the group including nitrogen-containing fuels including guanidine nitrate, nitroguanidine, triaminoguanidine nitrate, and other guanidine derivative fuels. Other known constituents such as other co-fuels, burn rate modifiers, binders, and slag forming compounds may also be utilized. These constituents include for example only, oxamide, metal oxides, cellulose acetate butyrate, clays, aluminas, and silicas, and mixtures thereof.

In sum, the present compositions may be described as a composition containing a nonmetal perchlorate as a first oxidizer; a metal nitrate, nitrite, or oxide as a secondary oxidizer; a first fuel selected from maleic hydrazide and salts of maleic hydrazide; and, a second nitrogen-containing fuel.

DETAILED DESCRIPTION OF THE PREFERRED EMBODIMENT(S)

Figure 1:
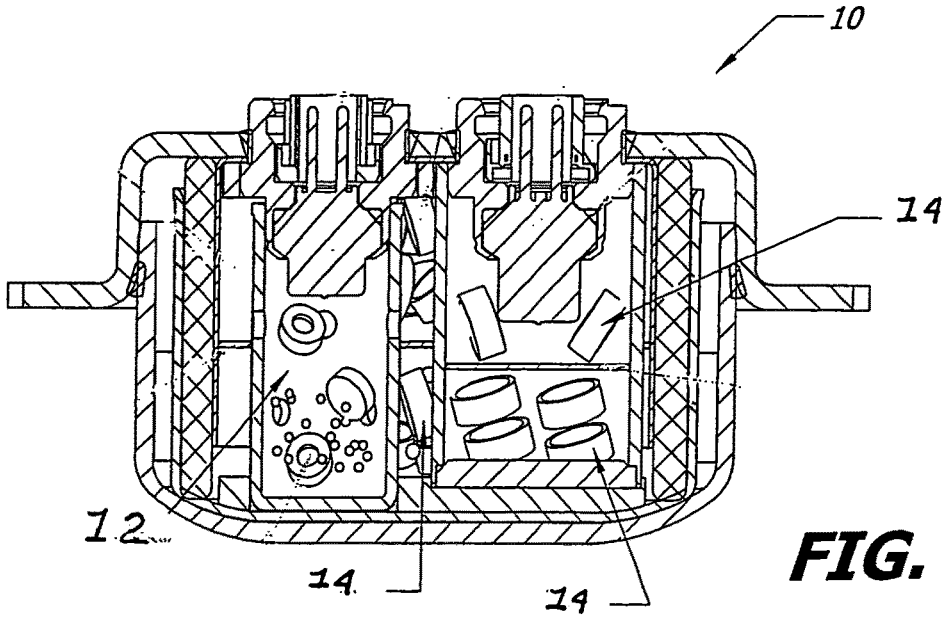
FIG. 1 is a cross-sectional side view showing the general structure of an inflator in accordance with the present invention.

The above-referenced concerns and others may be resolved by gas generating systems including an auto-ignition composition containing a first oxidizer selected from non-metal perchlorates such as ammonium perchlorate. Secondary oxidizers may also be employed including for example metal nitrates and nitrites, including alkali metal nitrates and alkaline earth metal nitrates such as strontium nitrate and sodium nitrate. Other secondary oxidizers may include basic metal nitrates such as basic copper nitrate; basic metal nitrates are more preferably used when salts of maleic hydrazide are employed. A first fuel is selected from the group including maleic hydrazide, and metal and nonmetal salts of maleic hydrazide. Metal and nonmetal salts of maleic hydrazide include but are not limited to copper, iron, and ammonium salts. Exemplary salts include copper (II) 3,6-dihydroxypyridazine, Iron (III) 3,6-dihydroxypyridazine, and ammonium 3,6-dihydroxypyridazine. A secondary fuel may be selected, but not by way of limitation, from the group including nitrogen-containing fuels selected from guanidine nitrate, nitroguanidine, triaminoguanidine nitrate, 5-aminotetrazole, bis-tetrazole, acidic tetrazole- and triazole-based fuels, guanidine derivative fuels, and mixtures thereof. Other known constituents such as other co-fuels, burn rate modifiers, binders, and slag forming compounds may also be utilized. These constituents include, for example only, oxamide, metal oxides, cellulose acetate butyrate, clays, aluminas, and silicas, and mixtures thereof.

The total oxidizer range, including first and secondary oxidizers, is about 40-60 weight percent, and the total fuel range, including first, second, and any tertiary fuel(s), is about 40-60 weight percent. All weight percents are provided relative to the weight of the total composition formed in accordance with the present invention. The first perchlorate oxidizer may be provided at about 20-50 weight percent. The secondary oxidizer may optionally be provided at about 0.1-25 weight percent. Maleic hydrazide, salts and derivatives thereof, and mixtures thereof, may be provided at about 1-25 weight percent. The secondary fuel may be provided at about 20-55 weight percent. A metal oxide may be provided at about 0.5 to 20 weight percent. An exemplary embodiment of an inventive composition includes about 34.5% guanidine nitrate, about 37.0% ammonium perchlorate, about 10.0% maleic hydrazide, about 11.0% sodium nitrate, and about 7.5% iron (III) oxide.

The constituents of the present invention may be provided by companies such as Aldrich and/or Fisher Chemicals, or other known suppliers and are generally dry mixed to result in the present compositions. The constituents are preferably provided in granulated or powdered form and comminuted in a planetary mixer or other suitable mixing device. A substantially homogeneous mixture may be formed by mixing over a period of time. The composition may be provided in granulated/powdered form, or the composition may be compacted and provided in pellet or tablet or other useful forms, for example.

EXAMPLES

The present invention is exemplified by the following examples, whereby one or more of the various benefits that are illustrated may be inherent in the present compositions.

Example 1

When using guanidine nitrate, one embodiment includes an auto-igniting gas generant containing about 20-30 wt % ammonium perchlorate, strontium nitrate at about 20-30 wt %, guanidine nitrate at about 40-55 wt %, and maleic hydrazide at about 1-10 wt %. The composition is formed by dry mixing the constituents in a granulated form in a known manner, and then pelletizing or otherwise forming the composition for further use. The constituents may be provided by Fisher Chemical, Aldrich Chemical, GFS, and other known suppliers. This embodiment exhibited an auto-ignition temperature determined by differential scanning calorimetry of about 150 C and a gas output of about 5.64 mols/100 cubic centimeters.

Example 2

When using nitroguanidine, a second embodiment, formed as in Example 1, includes an auto-igniting gas generant containing 20-30 wt % ammonium perchlorate, 15-25 wt % sodium nitrate, 30-50 wt % nitroguanidine, and about 1-15 wt % maleic hydrazide. This second embodiment exhibited a differential scanning calorimetric auto-ignition temperature of about 170 C and a gas output of about 6.13 mols/100 cubic centimeters.

Example 3

A third embodiment, formed as in Example 1, includes an auto-igniting/booster composition containing about 31.0 wt % ammonium perchlorate, about 22.6 wt % sodium nitrate, about 30.0 wt % nitroguanidine, about 11.4 wt % oxamide, and about 5.0 wt % maleic hydrazide. The gas yield was about 5.92 mols per 100 cubic centimeters. The total gas produced was 84.5 wt % of the combustion products. The total solids produced were 15.5 wt % of the combustion products. The auto-ignition temperature as determined by differential scanning calorimetry was about 168 C. The total mass density was 1.89 grams per cubic centimeter.

Example 4

A fourth embodiment, formed as in Example 1, includes an auto-igniting/booster composition containing about 27.0 wt % ammonium perchlorate, about 20.0 wt % sodium nitrate, about 48.0 wt % nitroguanidine, and about 5.0 wt % maleic hydrazide. The gas yield was about 6.13 mols per 100 cubic centimeters. The total gas produced was 86.4 wt % of the combustion products. The total solids produced were 13.6 wt % of the combustion products. The auto-ignition temperature as determined by differential scanning calorimetry was about 179 C. The total mass density was 1.88 grams per cubic centimeter.

Example 5

A fifth embodiment, formed as in Example 1, includes an auto-igniting/booster composition containing about 24.1 wt % ammonium perchlorate, about 22.0 wt % strontium nitrate, about 48.9 wt % guanidine nitrate, and about 5.0 wt % maleic hydrazide. The gas yield was about 5.64 mols per 100 cubic centimeters. The total gas produced was 83.6 wt % of the combustion products. The total solids produced were 16.4 wt % of the combustion products. The auto-ignition temperature as determined by differential scanning calorimetry was about 151 C. The total mass density was 1.72 grams per cubic centimeter.

This composition was also evaluated for moisture retention by exposing a known mass of this product within a glass vial to a relative humidity of about 60% over a twenty-four period. After twenty-four hours, the sample was found to retain about 0.11 wt % moisture relative to the total starting mass of the composition.

Example 6

A sixth embodiment, formed as in Example 1, includes an auto-igniting/booster composition containing about 25.1 wt % ammonium perchlorate, about 18.4 wt % sodium nitrate, about 51.5 wt % guanidine nitrate, and about 5.0 wt % maleic hydrazide. The gas yield was about 5.60 mols per 100 cubic centimeters. The total gas produced was 87.5 wt % of the combustion products. The total solids produced were 12.5 wt % of the combustion products. The auto-ignition temperature as determined by differential scanning calorimetry (DSC) was about 153 C. The total mass density was 1.63 grams per cubic centimeter.

This composition was also evaluated for moisture retention by exposing a known mass of this product within a glass vial to a relative humidity of about 60% over a twenty-four period. After twenty-four hours, the sample was found to retain about 0.02 wt % moisture relative to the total starting mass of the composition.

Example 7

A seventh embodiment, formed as in Example 1, includes an auto-igniting/booster composition containing about 31.6 wt % ammonium perchlorate, about 12.5 wt % strontium nitrate, about 44.9 wt % guanidine nitrate, and about 5.0 wt % maleic hydrazide. The total gas produced was 80.5 wt % of the combustion products. The total solids produced were 19.5 wt % of the combustion products. The auto-ignition temperature as determined by differential scanning calorimetry (DSC) was about 152 C. The total mass density was 1.76 grams per cubic centimeter.

Example 8

An eighth embodiment, formed as in Example 1, includes an auto-igniting/booster composition containing about 32.0 wt % ammonium perchlorate, about 46.1 wt % guanidine nitrate, about 10.4 wt % sodium nitrate, about 6.0 wt % copper (II) oxide, about 0.5 wt % graphite, and about 5.0 wt % maleic hydrazide. The gas yield was about 5.59 mols per 100 cubic centimeters. The total gas produced was 82.7 wt % of the combustion products. The total solids produced were 16.3 wt % of the combustion products. The auto-ignition temperature as determined by differential scanning calorimetry (DSC) was about 152 C.

This composition was also evaluated for moisture retention by exposing a known mass of this product within a glass vial to a relative humidity of about 60% over a twenty-four period. After twenty-four hours, the sample was found to retain about 0.07 wt % moisture relative to the total starting mass of the composition.

Example 9

A ninth embodiment, formed as in Example 1, includes an auto-igniting/booster composition containing about 47.5 wt % ammonium perchlorate, about 16.5 wt % copper (II) oxide, about 26.0 wt % guanidine nitrate, and about 10.0 wt % maleic hydrazide. The total gas produced was 72.5 wt % of the combustion products. The total solids produced were 27.5 wt % of the combustion products. The auto-ignition temperature as determined by differential scanning calorimetry (DSC) was about 156 C. The total mass density was 1.92 grams per cubic centimeter.

Example 10

A tenth embodiment, formed as in Example 1, includes an auto-igniting/booster composition containing about 29.5 wt % ammonium perchlorate, about 52.0 wt % guanidine nitrate, about 6.9 wt % sodium nitrate, about 6.9 wt % iron (III) oxide (Alpha nano), and about 4.6 wt % maleic hydrazide. The gas yield was about 5.61 mols per 100 cubic centimeters. The total gas produced was 83.1 wt % of the combustion products. The total solids produced were 16.9 wt % of the combustion products. The auto-ignition temperature as determined by differential scanning calorimetry (DSC) was about 149 C.

This composition was also evaluated for auto-ignition retention after heat aging a three gram sample in a sealed glass vial at 107 degrees Celsius for about 408 hours. Furthermore, this composition underwent thermal shock testing for 200 cycles. One cycle includes exposing the sample to −40 C for one half hour and then substantially instantaneously bringing the ambient temperature to 90 C and again exposing the sample for one half hour. The next cycle then begins by substantially instantaneously reducing the temperature back to −40 C and again beginning the exposure to each temperature extreme. After undergoing both heat aging and thermal shocking, this composition maintained its auto-ignition function at about 149-152 C.

Example 11

An eleventh embodiment, formed as in Example 1, includes an auto-igniting/booster composition containing about 37.0 wt % ammonium perchlorate, about 34.5 wt % guanidine nitrate, about 11.0 wt % sodium nitrate, about 7.5 wt % iron (III) oxide (Alpha nano), and about 10.0 wt % maleic hydrazide. The mixture, at 2.3 grams, was loaded in a known way as a booster composition into a known inflator such as shown in FIG. 1, and then actuated. Ballistic performance indicated time to first gas at about 0.0023 seconds (2.3 ms) and reached a chamber pressure of about 40.5 MPa at 0.012 seconds; 60 L tank pressure evaluation indicated a maximum pressure of about 195 kPa at about 0.05 seconds after inflator actuation, dropping to about 182 kPa at about 0.1 seconds after actuation. This composition yields about 5.52 mols of gas per 100 cubic centimeters with gas products constituting about 80.6% and solid products constituting about 19.4. The auto-ignition temperature of this composition was measured by differential scanning calorimetry (DSC) to be about 149 degrees Celsius.

This composition was also evaluated for moisture retention by exposing a known mass of this product within a glass vial to a relative humidity of about 60% over a twenty-four period. After twenty-four hours, the sample was found to retain about 0.13 wt % moisture relative to the total starting mass of the composition.

As compared to example 12, this example illustrates that the present compositions from a ballistic, environmental, and gas production standpoint, perform at least on a par and generally perform better than the more complex and more expensive compositions now known. As also indicated from Example 10, and equally important, no desiccant is required in conjunction with the use of the present compositions to ensure effective performance after heat aging and thermal shock testing.

Comparative Example 12

A comparative auto-ignition/booster composition contains a dry-mixed homogeneous mixture of potassium nitrate in an oxidizing amount, 5-aminotetrazole as a fuel, potassium 5-aminotetrazole, and molybdenum trioxide. The mixture was loaded in a known way into a known inflator such as shown in FIG. 1, and then actuated. Ballistic performance indicated time to first gas at about 0.0025 seconds (2.5 ms) and a chamber pressure of about 38.5 MPa at 0.013 seconds; 60 L tank pressure evaluation indicated a maximum pressure of about 197 kPa at about 0.05 seconds after inflator actuation, dropping to about 185 kPa at about 0.1 seconds after actuation. This composition yields about 4.60 mols of gas per 100 cubic centimeters with gas products constituting about 66.1% and solid products constituting about 33.9%. The auto-ignition temperature of this composition was measured by differential scanning calorimetry (DSC) to be about 151 degrees Celsius.

When heat aged and shocked as described in Example 11, the performance of this composition benefits from the use of 13× molecular sieve to absorb the by-products and moisture that may liberate during the heat age and shock testing. Without the use of an additional environmental control such as a desiccant, the efficiency and performance of this composition is reduced.

This composition was also evaluated for moisture retention by exposing a known mass of this product within a glass vial to a relative humidity of about 50% over a twenty-four period. After twenty-four hours, the sample was found to retain about 0.51 wt % moisture relative to the total starting mass of the composition.

The examples provided above thereby exhibit the benefits of the present compositions as compared to other autoignition/booster compositions, and as compared to performance objectives typically considered favorable by original equipment manufacturers.

It will be appreciated that in further accordance with the present invention, gas generators made as known in the art and also vehicle occupant protection systems manufactured as known in the art are also contemplated. As such, autoignition compositions of the present invention are employed in gas generators, seat belt assemblies, and/or vehicle occupant protection systems, all manufactured as known in the art.

Figure 2:
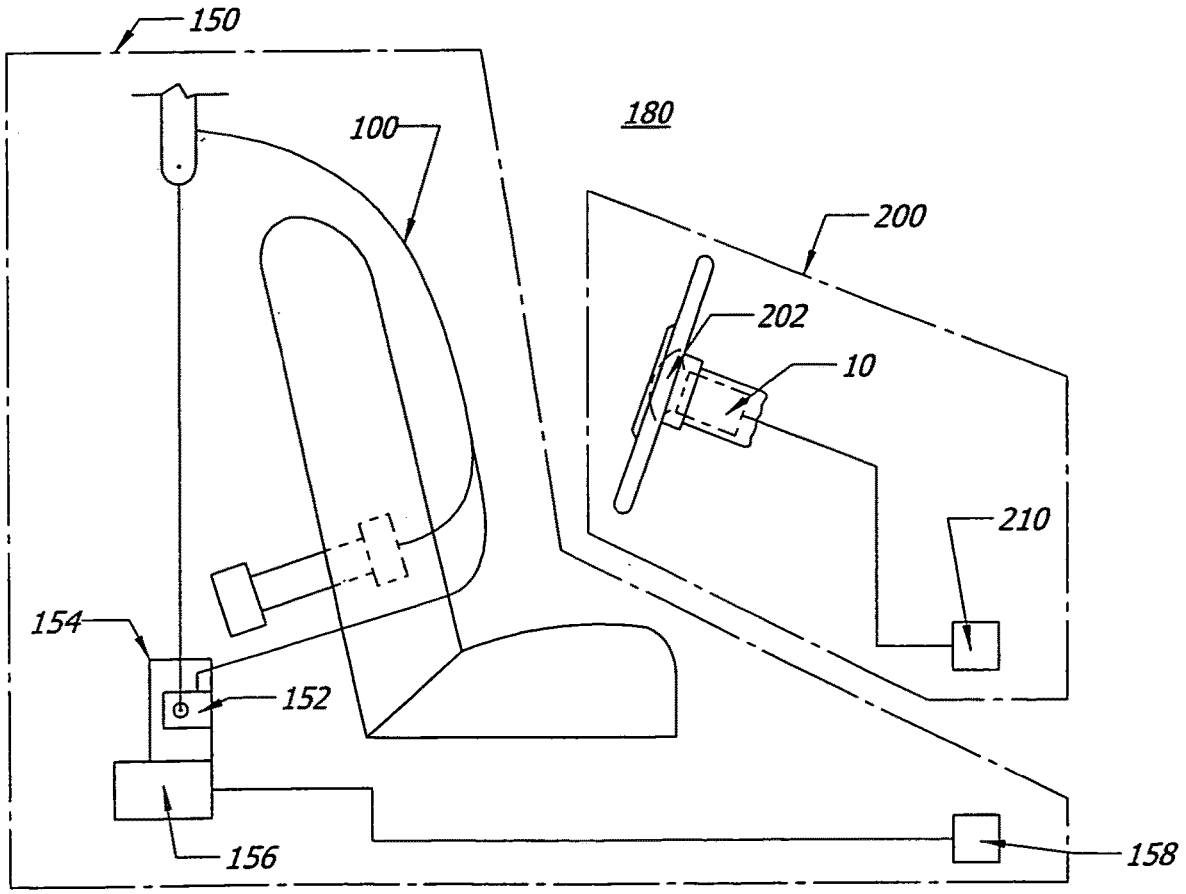
FIG. 2 is a schematic representation of an exemplary vehicle occupant restraint system containing a gas generant composition in accordance with the present invention.

In yet another aspect of the invention, the present compositions may be employed within a gas generating system. For example, as schematically shown in FIG. 2, a vehicle occupant protection system made in a known way contains crash sensors in electrical communication with an airbag inflator in the steering wheel, and also with a seatbelt assembly. The auto-igniting/booster compositions of the present invention may be employed in both subassemblies within the broader vehicle occupant protection system or gas generating system. More specifically, each gas generator employed in the automotive gas generating system may contain a gas generating composition as described herein.

The compositions may be dry mixed using methods known in the art. The various constituents are generally provided in particulate form and mixed to form a uniform mixture with the other gas generant constituents.

It should be noted that all percents given herein are weight percents based on the total weight of the gas generant composition. The chemicals described herein may be supplied by companies such as Aldrich Chemical Company for example.

As shown in FIG. 1, an exemplary inflator incorporates a dual chamber design to tailor the force of deployment of an associated airbag. In general, an inflator containing an auto-ignition/booster composition 12 formed as described herein, may be manufactured as known in the art. A known primary gas generating composition 14 is also provided. U.S. Pat. Nos. 6,422,601, 6,805,377, 6,659,500, 6,749,219, and 6,752,421 exemplify typical airbag inflator designs and are each incorporated herein by reference in their entirety.

Referring now to FIG. 2, the exemplary inflator 10 described above may also be incorporated into an airbag system 200. Airbag system 200 includes at least one airbag 202 and an inflator 10 containing an auto-ignition/booster composition 12 in accordance with the present invention, coupled to airbag 202 so as to enable fluid communication with an interior of the airbag. Airbag system 200 may also include (or be in communication with) a crash event sensor 210. Crash event sensor 210 includes a known crash sensor algorithm that signals actuation of airbag system 200 via, for example, activation of airbag inflator 10 in the event of a collision.

Referring again to FIG. 2, airbag system 200 may also be incorporated into a broader, more comprehensive vehicle occupant restraint system 180 including additional elements such as a safety belt assembly 150. FIG. 2 shows a schematic diagram of one exemplary embodiment of such a restraint system. Safety belt assembly 150 includes a safety belt housing 152 and a safety belt 100 extending from housing 152. A safety belt retractor mechanism 154 (for example, a spring-loaded mechanism) may be coupled to an end portion of the belt. In addition, a safety belt pretensioner 156 containing auto-ignition/booster composition 12 may be coupled to belt retractor mechanism 154 to actuate the retractor mechanism in the event of a collision. Typical seat belt retractor mechanisms which may be used in conjunction with the safety belt embodiments of the present invention are described in U.S. Pat. Nos. 5,743,480, 5,553,803, 5,667,161, 5,451,008, 4,558,832 and 4,597,546, each incorporated herein by reference. Illustrative examples of typical pretensioners with which the safety belt embodiments of the present invention may be combined are described in U.S. Pat. Nos. 6,505,790 and 6,419,177, incorporated herein by reference.

Safety belt assembly 150 may also include (or be in communication with) a crash event sensor 158 (for example, an inertia sensor or an accelerometer) including a known crash sensor algorithm that signals actuation of belt pretensioner 156 via, for example, activation of a pyrotechnic igniter (not shown) incorporated into the pretensioner. U.S. Pat. Nos. 6,505,790 and 6,419,177, previously incorporated herein by reference, provide illustrative examples of pretensioners actuated in such a manner.

It should be appreciated that safety belt assembly 150, airbag system 200, and more broadly, vehicle occupant protection system 180 exemplify but do not limit gas generating systems contemplated in accordance with the present invention.

The present description is for illustrative purposes only, and should not be construed to limit the breadth of the present invention in any way. Thus, those skilled in the art will appreciate that various modifications could be made to the presently disclosed embodiments without departing from the scope of the present invention as defined in the appended claims.

What is claimed is:

1. An auto-ignition composition consisting of:

a nonmetal perchlorate as a first oxidizer;

a secondary oxidizer selected from the group consisting of metal oxides, alkali metal nitrates, alkaline earth metal nitrates, and mixtures thereof, provided at about 12.5-30 weight percent of the total composition;

a first fuel selected from the group consisting of maleic hydrazide and salts thereof, and mixtures thereof, said first fuel provided at about 5-15 weight percent of the total composition; and a second nitrogen-containing fuel selected from the group consisting of acidic tetrazoles, acidic triazoles, guanidine, nitroguanidines, guanidine salts, guanidine derivatives, and mixtures thereof, wherein the composition has an auto-ignition temperature of 200° C. or less.

2. The composition of claim 1 wherein said salts of maleic hydrazide are selected from the group consisting of a metal salt of maleic hydrazide.

3. The composition of claim 1 wherein said second nitrogen fuel is selected from the group consisting of guanidine nitrate, nitroguanidine, bistetrazole, 5-aminotetrazole, and mixtures thereof.

4. The composition of claim 1 wherein said nonmetal perchlorate combined with said secondary oxidizer is provided at about 40-60 weight percent of the total composition.

5. The composition of claim 1 wherein said first fuel and said second nitrogen-containing fuel when combined are provided at about 40-60 weight percent of the total composition.

6. The composition of claim 1 wherein said first oxidizer is ammonium perchlorate.

7. The composition of claim 1, wherein said second oxidizer is selected from the group consisting of alkali and alkaline earth metal nitrates, and mixtures thereof.

8. The composition of claim 1 wherein said second oxidizer is selected from the group consisting of metal oxides.

9. The composition of claim 8 wherein said metal oxides are selected from the group consisting of iron (III) oxide and copper (II) oxide.

10. An auto-ignition composition consisting essentially of:

a nonmetal perchlorate as a first oxidizer, said first oxidizer provided at about 20-50 weight percent of the total composition; a secondary oxidizer selected from the group consisting of alkali metal nitrates, alkaline earth metal nitrates, and mixtures thereof, said second oxidizer provided at about 12.5-30 weight percent of the total composition;

a first fuel selected from the group consisting of maleic hydrazide and salts thereof, said first fuel provided at about 1-25 weight percent of the total composition;

a second nitrogen-containing fuel selected from the group consisting of tetrazoles and salts and derivatives thereof, triazoles and salts and derivatives thereof, and mixtures thereof, said second nitrogen-containing fuel provided at about 20-55 weight percent of the total composition; and a metal oxide selected from the group consisting of transitional metal oxides, said metal oxide provided at about 0.5-20 weight percent of the total composition, wherein the composition has an auto-ignition temperature of 200° C. or less.

11. A composition consisting of about 34.5% guanidine nitrate, about 37.0% ammonium perchlorate, about 10.0% maleic hydrazide, about 11.0% sodium nitrate, and about 7.5% iron (III) oxide.

12. The composition of claim 10 wherein said salts of maleic hydrazide are selected from the group consisting of copper, iron, and ammonium salts.

13. The composition of claim 10 wherein said salts of maleic hydrazide are selected from the group consisting of copper (II) 3,6-dihydroxypyridazine, iron (III) 3,6-dihydroxypyridazine, and ammonium 3,6-dihydroxypridazine.

14. The composition of claim 10 wherein said secondary oxidizer is selected from the group consisting of strontium nitrate, sodium nitrate, and mixtures thereof.

15. The composition of claim 10 wherein said transitional metal oxide is selected from the group consisting of copper (II) oxide, iron (III) oxide, and mixtures thereof.

16. The composition of claim 10 further consisting essentially of one or more constituents selected from the group consisting of burn rate modifiers, binders, and slag forming compounds.

17. The composition of claim 16 wherein said one or more constituents are selected from the group consisting of oxamide, cellulose acetate butyrate, clays, aluminas, silicas, and mixtures thereof.

18. An auto-ignition composition consisting of:

ammonium perchlorate;

a secondary oxidizer selected from the group consisting of metal oxides, alkali metal nitrates, alkaline earth metal nitrates, and mixtures thereof, said ammonium perchlorate and said secondary oxidizer provided at about 40-60 weight percent of the total composition, and said secondary oxidizer is provided at about 12.5-30 weight percent of the total composition;

maleic hydrazide provided at about 10 weight percent; and a second nitrogen-containing fuel selected from the group consisting of tetrazoles and salts and derivatives thereof, triazoles and salts and derivatives thereof, and mixtures thereof, said maleic hydrazide and said second nitrogen-containing fuel provided at about 40-60 weight percent of the total composition, wherein the composition has an auto-ignition temperature of 200° C. or less.

* * * * *